US005358385A

United States Patent [19]

Wang

[11] Patent Number: 5,358,385

[45] Date of Patent: Oct. 25, 1994

[54] DUAL DIAPHRAGM PUMP WITH ADJUSTABLE DISCHARGE SIDE PRESSURE TRIP SWITCH

[76] Inventor: Nancy Wang, No. 13, Minchuan Road, Tamshui Taipei, Taiwan

[21] Appl. No.: 122,089

[22] Filed: Sep. 16, 1993

[51] Int. Cl.[5] ..... F04B 39/00; F04B 45/04

[52] U.S. Cl. ..... 417/44.8; 417/234; 417/363; 417/413.1; 417/533; 417/539

[58] Field of Search ..... 417/44 G, 413 R, 533, 417/539, 234, 363

[56] References Cited

U.S. PATENT DOCUMENTS

| | | | |
|---|---|---|---|
| 2,748,606 | 6/1956 | Cornelius | 417/413 R |
| 3,282,224 | 11/1966 | Bock et al. | 417/413 R |
| 3,308,765 | 3/1967 | Mutschler et al. | 417/413 R |
| 3,612,731 | 10/1971 | Tanemoto | 417/533 |
| 4,789,310 | 12/1988 | Hung | 417/234 |
| 4,871,300 | 10/1989 | Outzen | 417/363 |
| 5,104,295 | 4/1992 | Wong | 417/234 |
| 5,118,262 | 6/1992 | Kuo | 417/363 |

FOREIGN PATENT DOCUMENTS

| | | | |
|---|---|---|---|
| 3112386 | 12/1982 | Fed. Rep. of Germany | 417/533 |

*Primary Examiner*—Richard A. Bertsch

*Assistant Examiner*—Roland G. McAndrews, Jr.

*Attorney, Agent, or Firm*—Lowe, Price, LeBlanc & Becker

[57] ABSTRACT

A new structure for an efficient electric pump is described. The electric pump of this invention mainly comprises a cover plate, a top cover and a housing to make up the outside appearance. Its inside consists of a dual piston device, an eccentric transmission device for the pistons to stroke up and down, an electric motor, a switch, an adjustable pressure switch, a rotary dial for adjusting said pressure switch and the associated circuitry. The cover plate has two circular ball-shaped chambers for the pistons to create the sucking and the discharging. In between the two ball-shaped chamber are discharge and suction channels which are independent from each other but are joined together. Two ends of the channel are provided with clack valves for controlling the air flow to be drawing in on one side and discharge on the other side. The pressure switch is disposed beneath the discharge channel so that the pressure switch trips when the discharge pressure extends a preset limit. In addition, the bottom of the housing is provided with a plurality of post legs with compression springs to prevent from excessive vibrating during operation.

1 Claim, 8 Drawing Sheets

DUAL DIAPHRAGM PUMP WITH ADJUSTABLE DISCHARGE SIDE PRESSURE TRIP SWITCH

BACKGROUND OF THE INVENTION (a) Field of the Invention

The present invention relates to a new structure for an electric pump, particularly to an electric pump having dual pistons device, pressure switch and special designed channels so that the air discharging and sucking operation are continuous.

(b) Description of the Prior Art

Pumps provide the means of accepting a mechanical power input and converting it to an equivalent amount of fluid power, fluid moving under pressure. According to a survey, air pumps can generally be categorized into several types: manual or foot air pumps, simple electric pumps, and electric motor or diesel engine driven air compressors. Among the different types of pumps, the manual air pump can often be seen in our daily life. It is recognized that the simple manual air pump is handy to be used everywhere. However, this kind of air pump has a limited power and the vigorous pumping is tedious. The electric motor or diesel engine powered air compressor is convenient to be used for higher capacity. However, its bulky physical size is not handy to be carried or moved around and this is a disadvantage- The introduction of the simple electric pump seems to have overcome the above disadvantage. It is small in size and is convenient to be carried around. Electric power is all that is needed to operate the simple electric pump. For these reasons, electric pumps are widely used in automobiles, boats and are becoming a necessity in our daily lives. The inventor, after several years of research in the related field, has found that certain drawbacks still exist in the simple electric pumps:

1. The operation of a simple electric pump uses a single piston to reciprocate so as to function as a pump. On the downstroke of the piston, air is forced to discharge. On the upstroke a suction is created under the piston. However, a single piston cannot maintain the continuous operation of sucking and discharging, it can only reciprocate fast enough so that the suction and discharge appears to be continuous. Thus, the speed of air filling is slower. In addition, the air loss and the reciprocating frictional loss are higher due to the discontinued stroking of the piston. Hence, the air flow capacity and the pumping efficiency are low.

2. The capacity to be pumped using the simple electric pump depends of the user's experience. A device to be pumped with a critical pressure requirement is not protected against over pumping.

3. Most of the simple electric pumps create a high frequency vibration during operation. The base of such electric pumps contact with the ground directly and can easily cause damage to the pump assembly.

Because of the aforesaid disadvantages, the inventor has spent a considerable amount of time to overcome those drawbacks. Hence, a new structure for an electric pump having a dual pistons, pressure switch, specially constructed channels and vibration-proof leg is developed.

SUMMARY OF THE INVENTION

The main object according to the present invention is to provide a new structure for an electric pump in which dual pistons are used to overcome the discontinued operation due to a single piston stroking. This makes the sucking and the discharging of the air to be continuous so that the speed and the efficiency of operation can be improved.

Another object according to the present invention is to provide a new structure for an electric pump in which a pressure switch is provided so that a preset pressure for operation can be obtained.

A further object according to the present invention is to provide a new structure for an electric pump having vibration-proof post legs to eliminate the vibration during operation.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
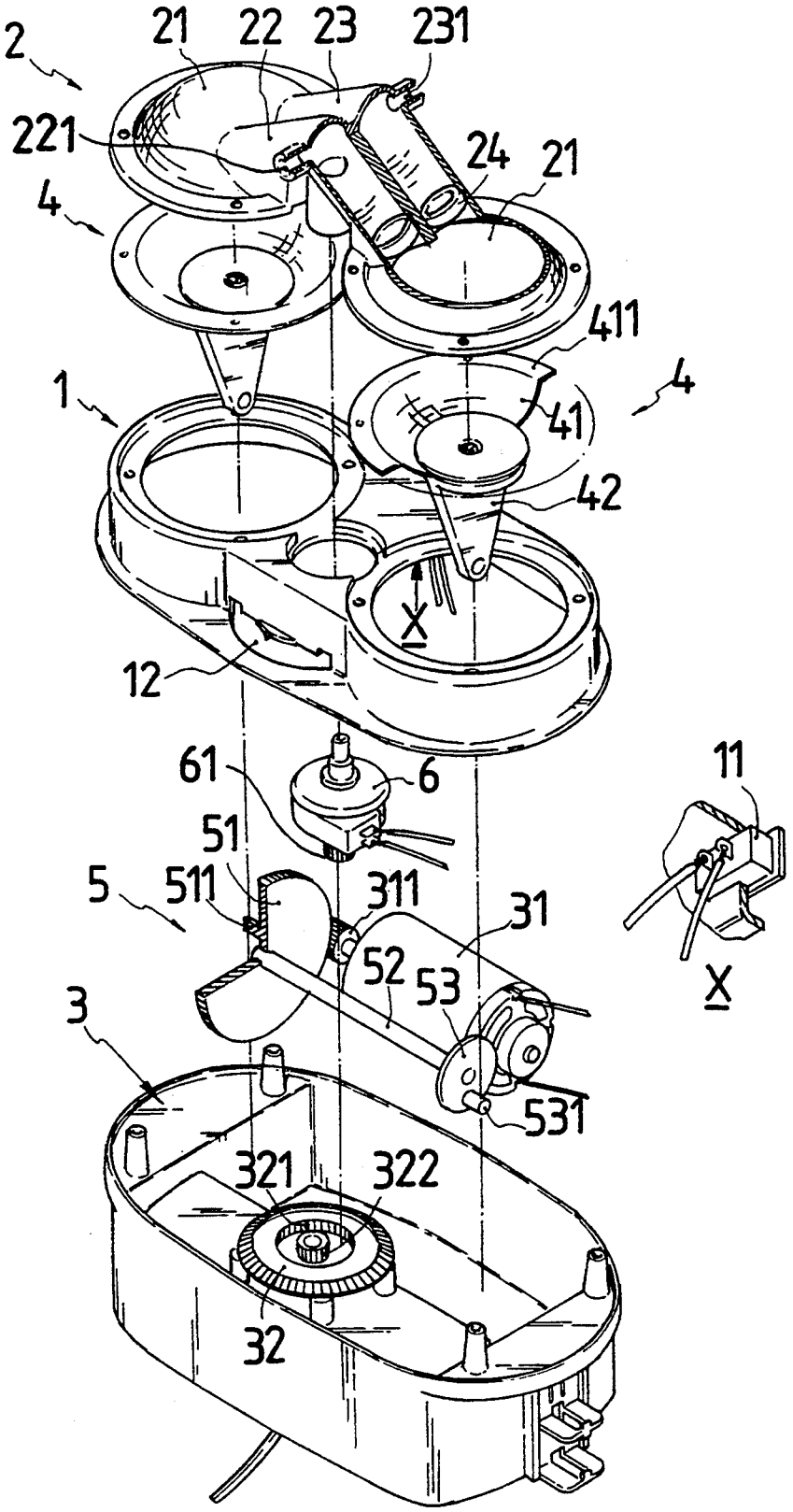
FIG. 1 is a perspective fragmented view and a detailed drawing on a partial section X of the electric pump according to the present invention.

Referring to FIG. 1, the new structure for an electric pump according to the present invention mainly consists of a top cover (1), a cover plate (2) which fits on top of the top cover (1), a dual pistons device (4) in which each piston set is made up of a suction disk (41) and a linkage (42), an eccentric transmission device (5) which consists of a large gear (51) , a transmission rod (52) and an eccentric wheel (53) , an electric motor (31) , a switch (11) , a pressure switch (6), a rotary dial (32) for adjusting the pressure switch (6) and a housing (3) for holding the above components.

Figure 5A:
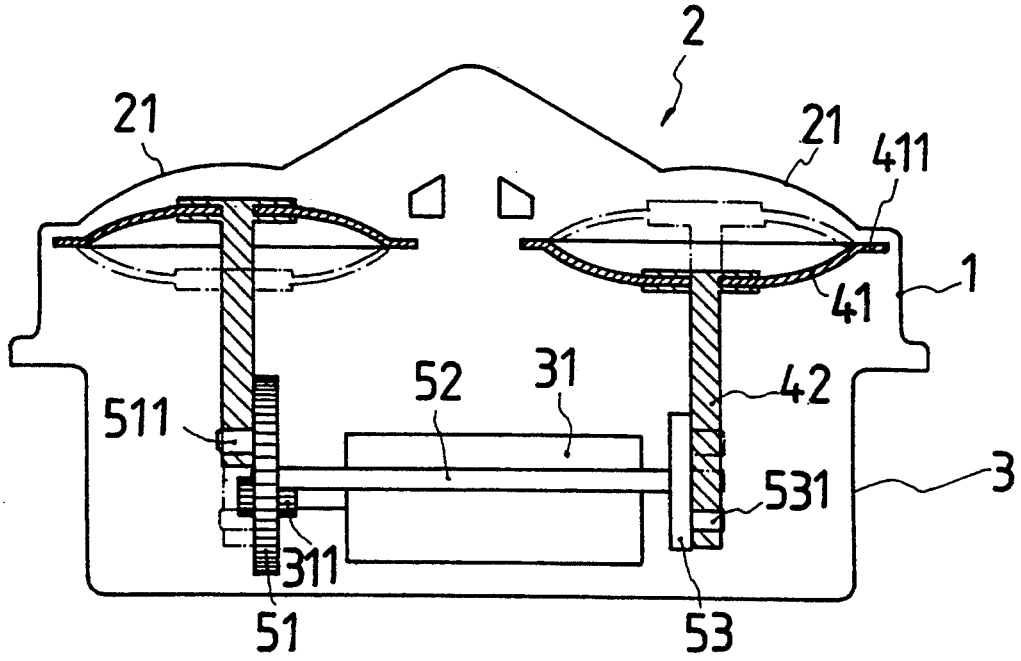
FIGS. 5A and 5B shows the operation of the dual pistons used in the electric pump according to the present invention.
Figure 5B:
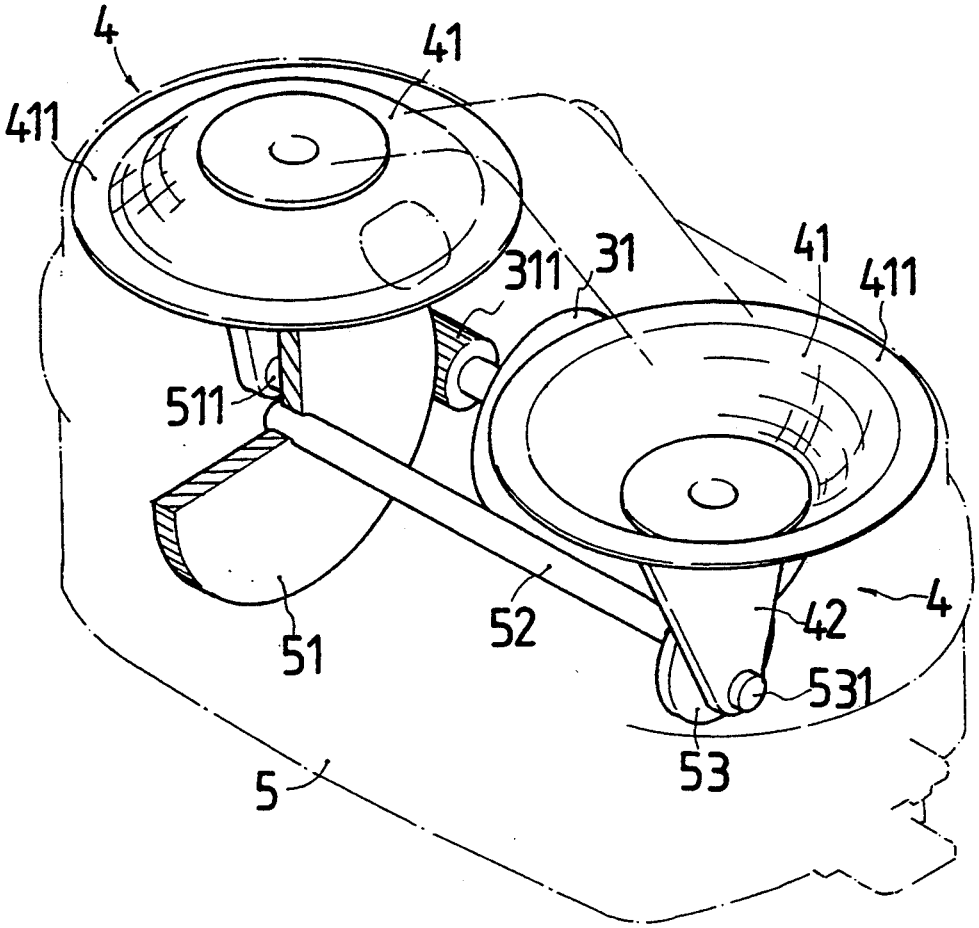

The electric pump in accordance with the present invention is characterized in that a compressible dual pistons device (4) is used. The electric motor (31) drives the eccentric device (5) to cause the dual pistons device (4) to move up and down inside the circular ball-shaped chamber (21) of the cover plate (2). This up-and-down compression creates a suction and a discharge for the air, as can be shown in FIGS. 5A and 5B. The electric motor (31) and the eccentric transmission device (5) can be housed inside the housing (3). The small gear (311) on the shaft of the electric motor (31) gears with the large gear (51) of the eccentric transmission device (5), and the large gear (51) is also connected axially to the eccentric wheel (53) through the transmission rod (52). Therefore, when the electric motor (31) starts, the large gear (51) and the eccentric wheel (53) are being driven. Moreover, the outside surfaces of the large gear (51) and the eccentric wheel (53) are provided with two eccentric posts (511) and (531) which are projected eccentrically from the transmission rod (52). In addition, the two eccentric posts (511) and (531) are located 180 degrees apart looking from the axial direction, allowing the eccentric post (511) to be on the top while the other eccentric post (531) is on the bottom. The eccentric distances between the posts and the transmission rod (52) determines the stroking path of the dual pistons device (4) since the bottom of the linkages (42) are linked to eccentric posts (511) and (531). The top of the linkages (42) are provided with a soften suction disk (41) which has a flange (411) for the cover plate (2) and the top cover (1) to be clamped together. This allows the suction disk (41) to be moved in the limited space inside the ball-shaped chamber (21) of the cover plate (2). By such configuration, the eccentric transmission device (5) is driven by the electric motor (5), and the dual pistons device (4) creates an upstroke on one piston and a downstroke on the other piston so that the sucking and the discharging operate concurrently.

Figure 4A:
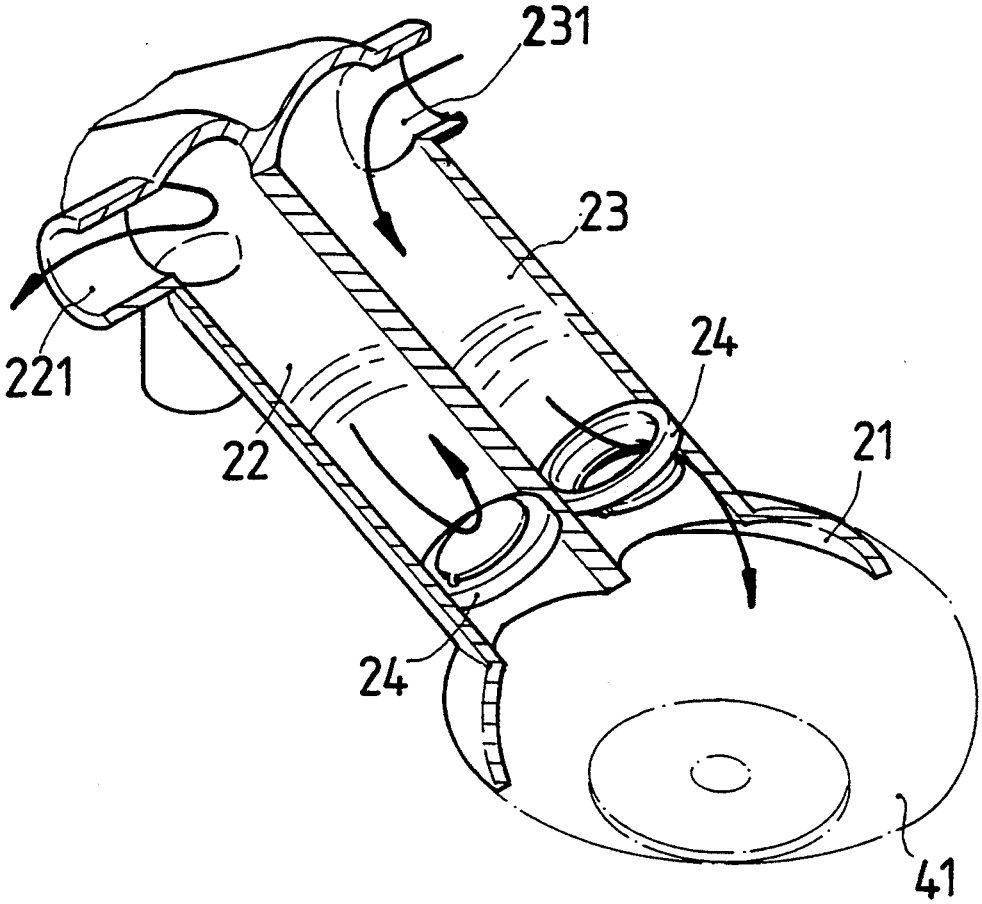
FIGS. 4A and 4B shows the direction of the air flow of the suction and the discharge channels in the electric pump according to the present invention.
Figure 4B:
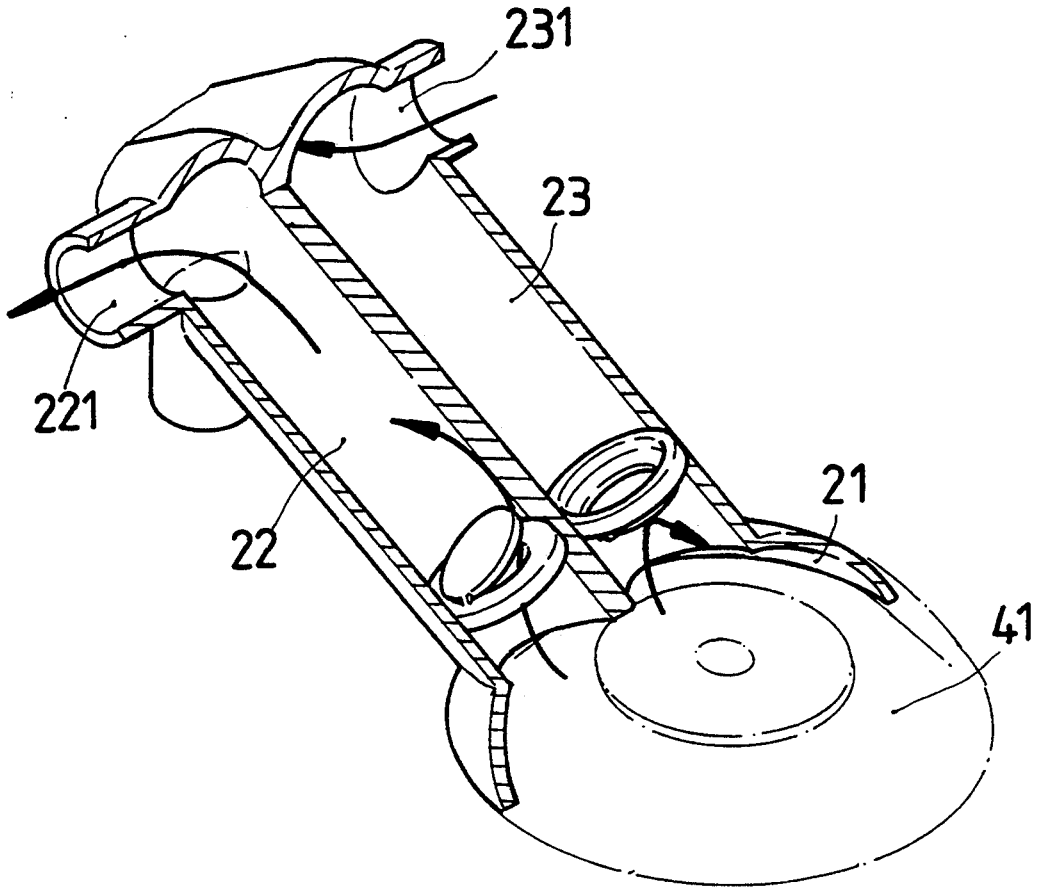

Please refer to FIGS. 4A and 4B for the compressed air flow of the suction disk (41) inside the ball-shaped chamber (21). Let's look back to FIG. 1 first so that the overall structure of the cover plate (2) is fully understood. The left and the right hand sides of the cover plate (2) are respectively provided with a ball-shaped chamber (21) for the suction disk (41) to compress the air. The two ball-shaped chambers (21) are provided with discharge and suction channels (22) and (23) which are independent from each other but are joined to form an inverted V-shaped passage. Both of the channels (22) and (23) have their respective discharge nozzle (221) and suction nozzle (231). The ends of the channels (22) and (23) which are close to the ball-shaped chamber (21) are provided with clack valves (24), characterized in that the clack valve (24) on the discharge channel (22) only allows air to pass from the ball-shaped chamber (21) into the discharge channel (22), the clack valve (24) on the suction channel (23) only allows the air flow from the suction channel (23) into the ball-shaped chamber (21). Accordingly, when the suction disk (41) is being pulled down, as is shown in FIG. 4A, air is being drawn from the suction nozzle (231), through the suction channel (23) and its clack valve (24) into the ball-shaped chamber (21), and the air inside the discharge channel (22) is being blocked by its associated clack valve (24). FIG. 4B shows the reverse operation in which the suction disk (41) is being pushed upward, air inside the ball-shaped chamber (21) is pushed through the clack valve (24) and the discharge channel (22) to exit the discharge nozzle (221). Air will not be allowed to enter into the suction channel (23) in this case. FIGS. 4A and 4B show the operation on one side, the operation on the other side is similar but is reversed. In other words, the operation on one side is shown in FIG. 4A while the operation on the other side is shown in FIG. 4B. Therefore, the operation allows the discharge nozzle (221) to be able to discharge air continuously while the suction nozzle continues to draw air in. This greatly enhances the efficiency of the electric pump.

Figure 2:
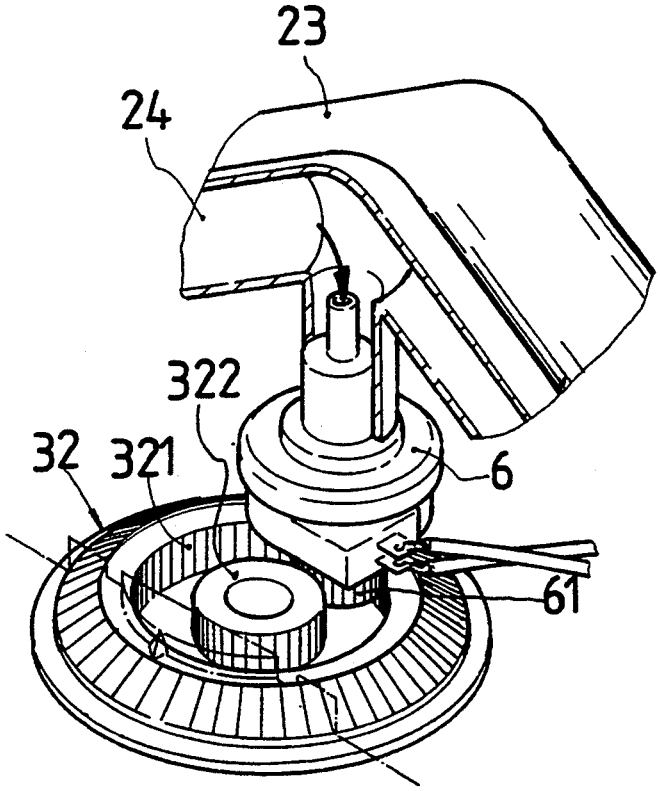
FIG. 2 is a diagrammatic showing the adjustment of the rotary dial adjusting the pressure switch of the electric pump according to the present invention.

Another feature of the electric pump according to the present invention is the use the pressure switch (6) provided right underneath the discharge channel (22). The pressure switch (6) is connected in series with the switch (11) which is located on the other side of the top cover (1), as shown in the detailed drawing of the X section of FIG. 1. When the switch (11) is turned on to start up the electric motor (31) for pumping operation, the pressure switch (6) senses the pressure of the discharge channel (22). If the pressure of the discharge channel (22) exceeds a preset value, the pressure switch (6) trips and cuts off the power to the electric motor (31). The pressure switch (6) is an adjustable device with a rotary dial (32) underneath for adjusting said pressure switch (6). Moreover, a slot (12) is opened in a relative position in the top cover (1) such that the rotary dial is exposed partially for adjustment when the top cover (1) and the housing (3) are put together. The adjustment of the rotary dial (32) on the pressure switch (6) is shown in FIG. 2. The rotary dial (32) has a circular disk shape, the center of which is provided with an inner gear ring (321) and is loosely connected to a tooth post (322), allowing it to be geared with the adjustment screw tooth (61). When the rotary dial (32) is rotated by the user, the inner gear ring (321) drives the adjustment screw tooth (61) so that proper pressure can be adjusted. The tooth post (322) rotates relatively with the rotary dial (32) and is loosely connected to the latter. The function of the tooth post (322) is to secure the adjustment screw tooth (61) so that a smooth operation can be obtained when the rotary dial (32) is used to adjust the screw tooth (61).

Figure 3:
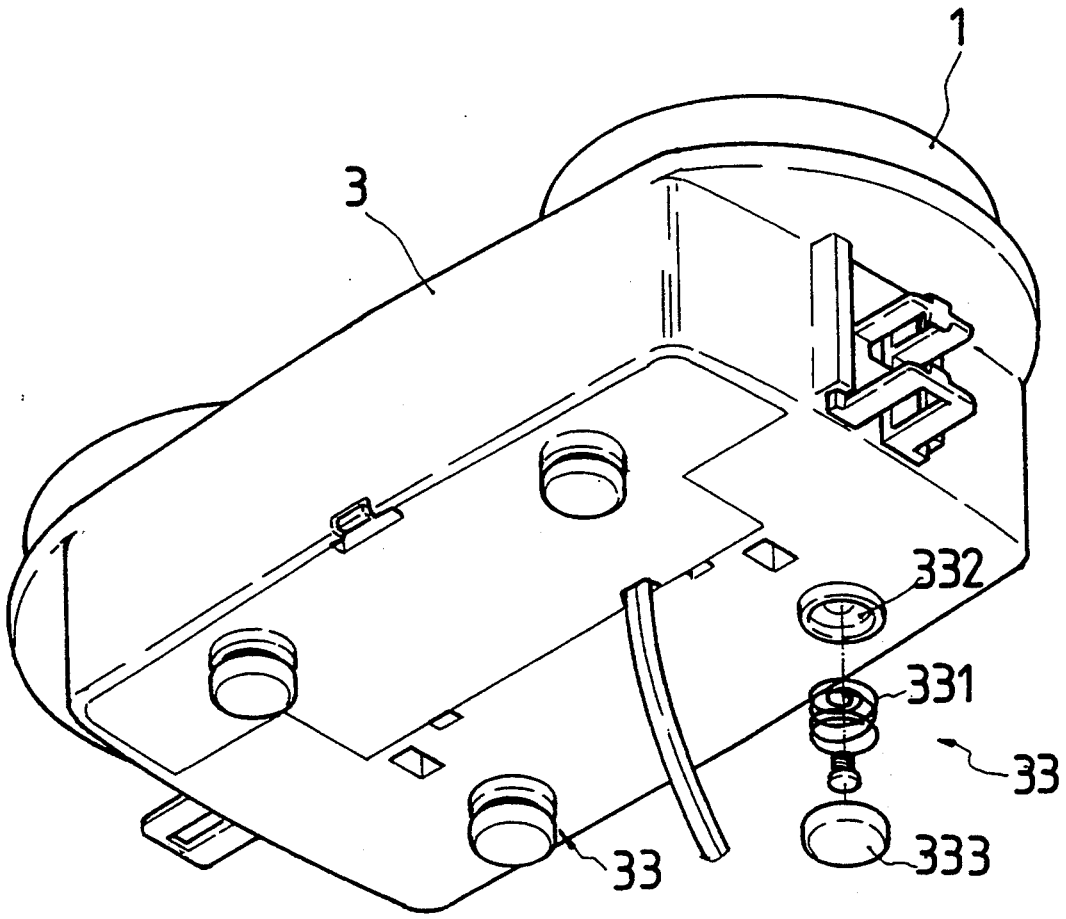
FIG. 3 shows the assembly of the post legs on the bottom of the electric pump according to the present invention.

It can be noted from FIG. 3 that 4 four legs (33) are provided on the bottom of the electric pump according to the present invention. Each of the post leg (33) has a compression spring (331) connected to the post hole (332) on the bottom of the housing (3). A padding (333) is then added to the end of each post opposite the spring so that vibration from the electric motor (31) is absorbed and the collision of the components due to vibration is greatly reduced.

Figure 6:
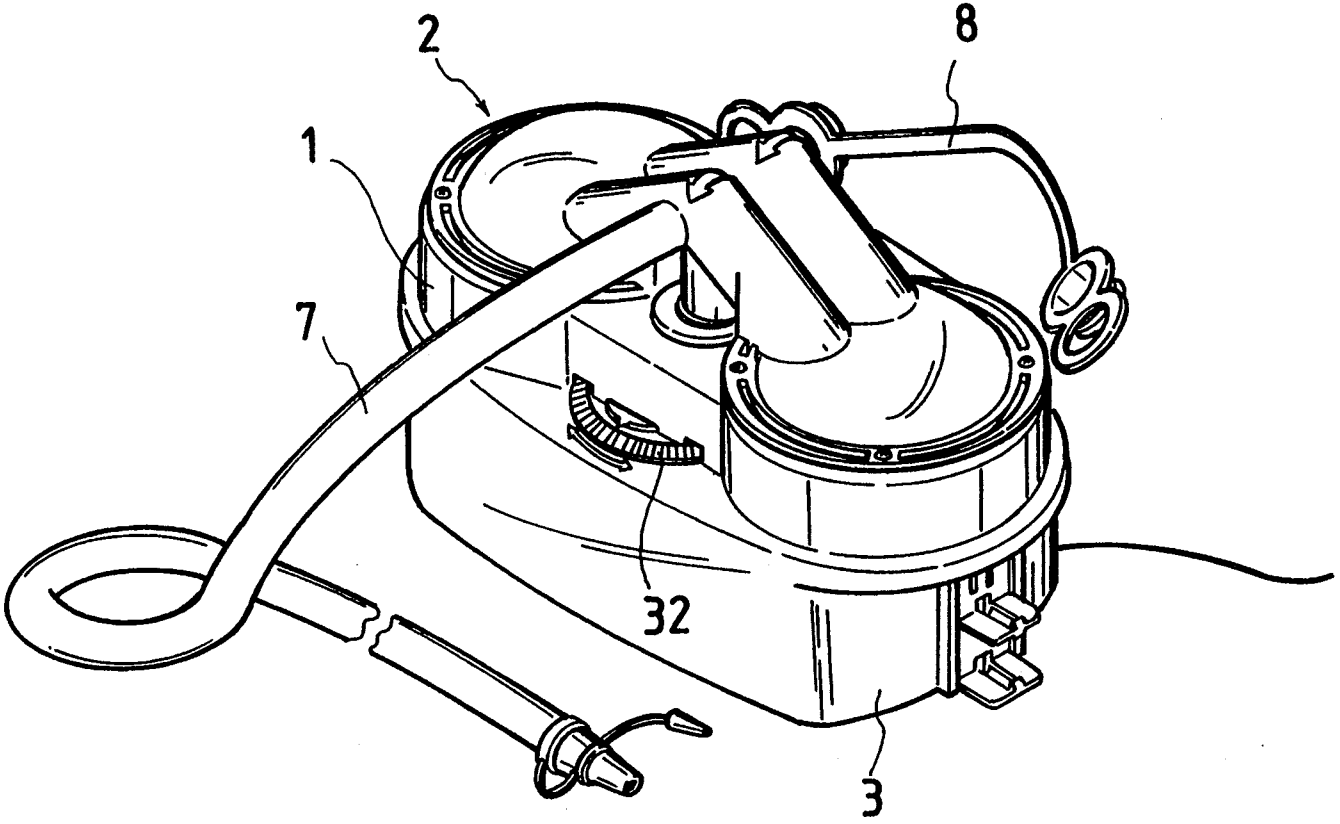
FIG. 6 is a preferred embodiment of the electric pump according to the present invention.

FIG. 6 shows an embodiment of the electric pump according to the present invention. Flexible tubing (7) is added to the discharge and the suction nozzles (221) and (231) and a handle (8) is also added to expand the application.

The foregoing description of the preferred embodiment of the invention has been presented for the purpose of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A new structure for an electric pump comprising a housing and a top cover therefor, a cover plate forming a ball shaped chamber which fits on top of said top cover, and pump components including a dual piston device in which each piston set has a suction disk and a linkage member, an eccentric transmission device which further consists of a large gear, a transmission rod and an eccentric wheel, an electric motor having an output shaft and a small gear mounted thereon, a switch, a pressure switch, a rotary dial for adjustment of said pressure switch said housing containing said components wherein:

said electric motor and said eccentric transmission device are housed inside said housing, the small gear on the shaft of said electric motor meshing with the large gear of the eccentric transmission device, and the large gear being also connected axially to the eccentric wheel through the transmission rod, the outside face surfaces of the large gear and the eccentric wheel being provided with eccentric posts which axially spaced from the transmission rod parallel thereto, and located 180 degrees apart from each other, thereby when one eccentric post is disposed below said rod the other is disposed above said rod, each of the linkages extending between one of said eccentric posts, and one of said suction disks, each disk having a flange secured between the cover plate and the top cover whereby each suction disk to be free to move within the ball-shaped chamber formed by the cover plate;

the ball shaped chamber of said cover plate provided with left and right ball-shaped areas which receive respectively the said suction disks, the two-ball-shaped areas having discharge and suction channels which are separate but are joined to form an inverted V-shaped passage, each of the channels having respective discharge nozzle and suction nozzle, the ends of the channels disposed adjacent the ball-shaped chamber having clack valves, characterized in that the clack valve on the discharge channel only allows air to pass from the ball-shaped chamber into the discharge channel, the clack valve on the suction channel only allows the air flow from the suction channel into the ball-shaped chamber so that when the suction disk is pulled downwardly, air is drawn from the suction nozzle, through the suction channel and its clack valve into the ball-shaped chamber, and when the suction disk is pushed upwardly, air inside the ball-shaped chamber is pushed through the clack valve and the discharge channel to exit the discharge nozzle;

said pressure switch sensing the pressure inside the discharge channel, and said pressure switch being connected in series with said switch which is coupled to control a source of the electrical power to said electric motor, said pressure switch including adjustment means including an adjustment screw tooth, for adjusting the switch pressure and a rotary dial the center of said dial connected to a tooth post, allowing it to be geared with the adjustment screw tooth, and a slot being provided in the top cover so that the rotary dial is exposed partially for adjustment when the top cover and the housing are assembled.

the bottom of said housing mounting a plurality of post support legs at post holes therein, each of legs having a compression spring provided in a post hole on the bottom of said housing, and a padding provided on each leg opposite the spring whereby vibrations transmitted thereto are dampened.

* * * * *